US006923662B2

(12) United States Patent
Sasame et al.

(10) Patent No.: US 6,923,662 B2
(45) Date of Patent: Aug. 2, 2005

(54) ELECTRICAL CONNECTOR

(75) Inventors: Naotaka Sasame, Tokyo (JP); Shinichi Hashimoto, Kanagawa (JP)

(73) Assignee: Tyco Electronics AMP K.K., Kanagawa (JP)

( * ) Notice: Subject to any disclaimer, the term of this patent is extended or adjusted under 35 U.S.C. 154(b) by 3 days.

(21) Appl. No.: 10/630,325

(22) Filed: Jul. 30, 2003

(65) Prior Publication Data

US 2004/0023533 A1 Feb. 5, 2004

(30) Foreign Application Priority Data

Jul. 31, 2002 (JP) ..... 2002-222932

(51) Int. Cl.[7] ..... H01R 13/60
(52) U.S. Cl. ..... 439/79; 439/567; 439/954
(58) Field of Search ..... 439/79, 567, 954, 439/569–570, 74, 246–249, 76.1, 637

(56) References Cited

U.S. PATENT DOCUMENTS 6,551,116 B1 * 4/2003 Liu ..... 439/79
6,638,104 B2 * 10/2003 Hashimoto et al. ..... 439/567

FOREIGN PATENT DOCUMENTS

JP 62-1987-18984 2/1987 ..... H01R/23/68
JP 2824748 9/1998 ..... H01R/23/68

* cited by examiner

*Primary Examiner*—P. Austin Bradley
*Assistant Examiner*—Felix O. Figueroa
(74) *Attorney, Agent, or Firm*—Barley Snyder LLC

(57) ABSTRACT

An electrical connector has an insulative housing with a mounting surface that is inclined at a predetermined angle with respect to a plane perpendicular to an engagement direction with another connector. A plurality of contacts is arranged in the insulative housing. Each contact has a tine that extends parallel to the engagement direction for insertion into through-holes of a circuit board. An aligning member is attached to the insulative housing. The aligning member has a plurality of apertures for receiving and aligning the tines and standoffs that reduce bending stress applied to the tines. The standoffs abut the circuit board so that the aligning member inclines at an angle less than the predetermined angle when the insulative housing is mounted on the circuit board to reduce bending stress applied to the tines.

17 Claims, 19 Drawing Sheets

ELECTRICAL CONNECTOR

BACKGROUND OF THE INVENTION

The invention relates to an electrical connector and, more particularly, to an electrical connector that is mounted on a printed circuit board in an inclined manner and has a contact aligning member.

DESCRIPTION OF THE PRIOR ART

Electrical connectors that are mounted on printed circuit boards (circuit boards) are commonly used as a means to electrically connect circuit boards having electronic components mounted thereon to each other. For example, in personal computers and the like, electrical connectors are used at connecting portions for connecting with accessories at rear portions thereof. The electrical connectors are each fixed onto a circuit board and are configured to engage as the circuit boards approach each other. However, in some instances, at least one of the circuit boards is positioned such that it is inclined with respect to the other circuit board. As such, at least one of the electrical connectors is required to be mounted on the circuit board in an inclined manner.

One example of an electrical connector of this type is a multipolar connector disclosed in Japanese Unexamined Utility Model Publication No. 62(1987)-18984. This connector has an engagement direction that is inclined with respect to a circuit board. A bottom surface of a housing of the connector is directly mounted to the circuit board. Contacts that extend from the housing are inserted through the circuit board and are bent for attachment to an opposite side thereof. This reference does not teach an aligning member between the housing of the connector and the circuit board, nor is there sufficient space to accommodate such an aligning member.

Another example of an electrical connector of this type is disclosed in Japanese Patent No. 2824748. This electrical connector has an aligning member. The aligning member aligns tines of contacts prior to insertion of the tines through a circuit board. When the electrical connector is mounted on the circuit board in an inclined manner, the similarly inclined aligning member applies a large load on the tines, which exerts great stress on leg portions of the contacts. This stress may cause cracks to form at soldered portions of the tines.

It is therefore desirable to develop an electrical connector wherein the load that is applied on the tines of the contacts is reduced, even if the electrical connector is mounted in an inclined manner.

SUMMARY OF THE INVENTION

The invention relates to an electrical connector having an insulative housing with a mounting surface that is inclined at a predetermined angle with respect to a plane perpendicular to an engagement direction with another connector. A plurality of contacts is arranged in the insulative housing. Each contact has a tine that extends parallel to the engagement direction for insertion into through-holes of a circuit board. An alignment member has a base plate provided with a plurality of apertures for receiving and aligning the tines. The base plate has standoffs that protrude from the base plate to abut the circuit board such that bending stress applied to the tines by the inclined mounting surface is reduced.

BRIEF DESCRIPTION OF THE DRAWINGS

FIG. 6 shows a metal holding piece that is attached to a mounting portion.

FIG. 7 shows a shell that is attached to the housing of the plug connector.

FIG. 8 shows a movable contact aligning member of the plug connector.

FIG. 15 shows an electrostatic discharge (ESD) wire used by the receptacle connector of FIG. 10.

FIG. 17 shows an ESD contact that is arranged in a vicinity of the guide hole of FIG. 16.

FIG. 19 shows another embodiment of an ESD contact.

DETAILED DESCRIPTION OF THE PREFERRED EMBODIMENT

Figure 1:
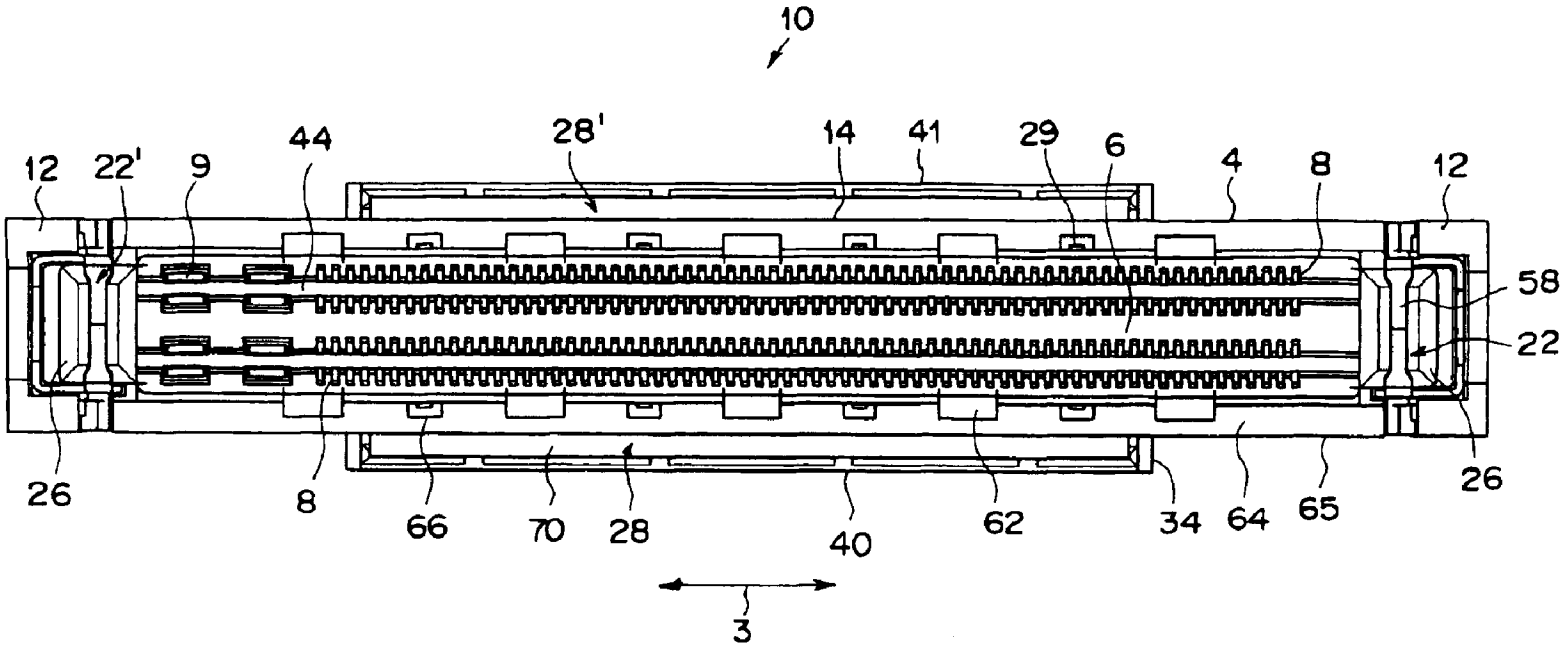
FIG. 1 is a plan view of a plug connector.
Figure 2:
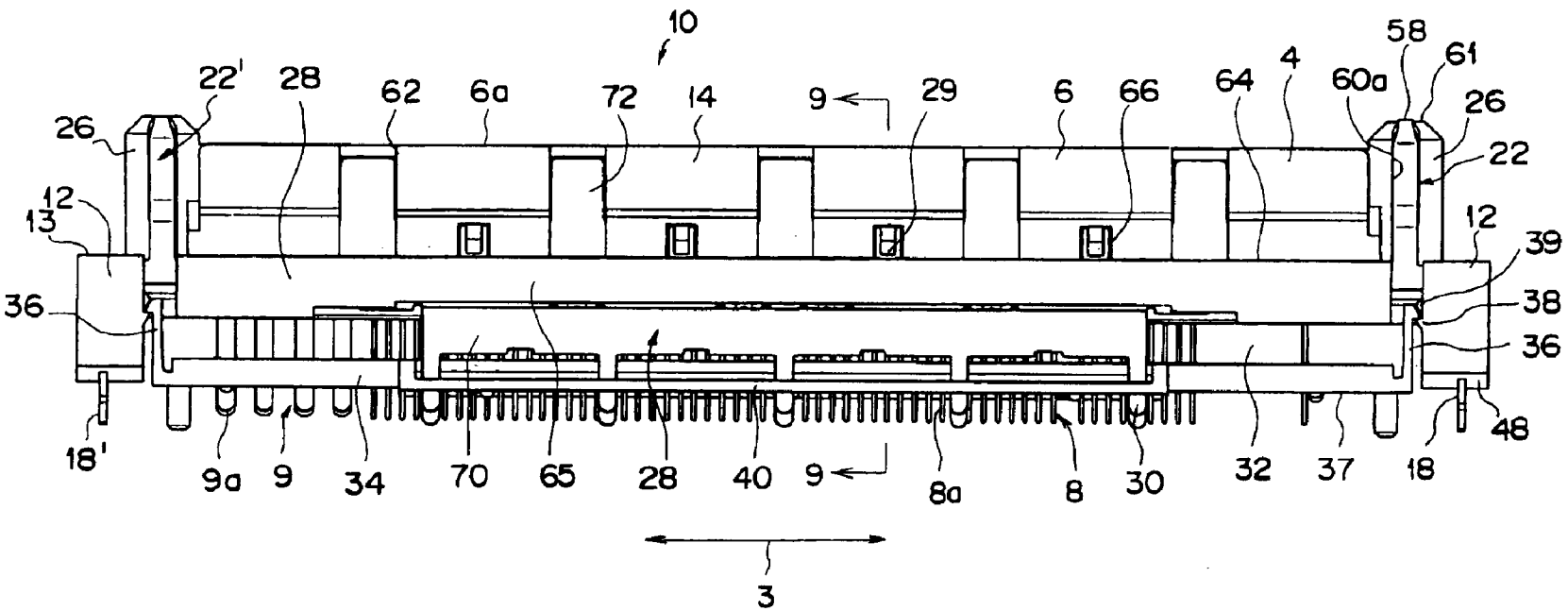
FIG. 2 is a front view of the plug connector of FIG. 1.
Figure 3:
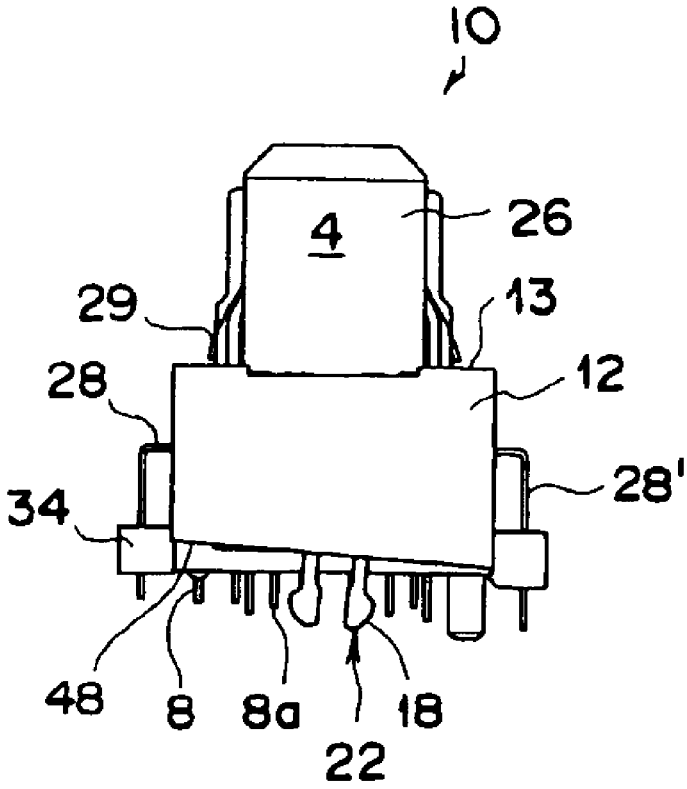
FIG. 3 is a right side view of the plug connector of FIG. 1.
Figure 4:
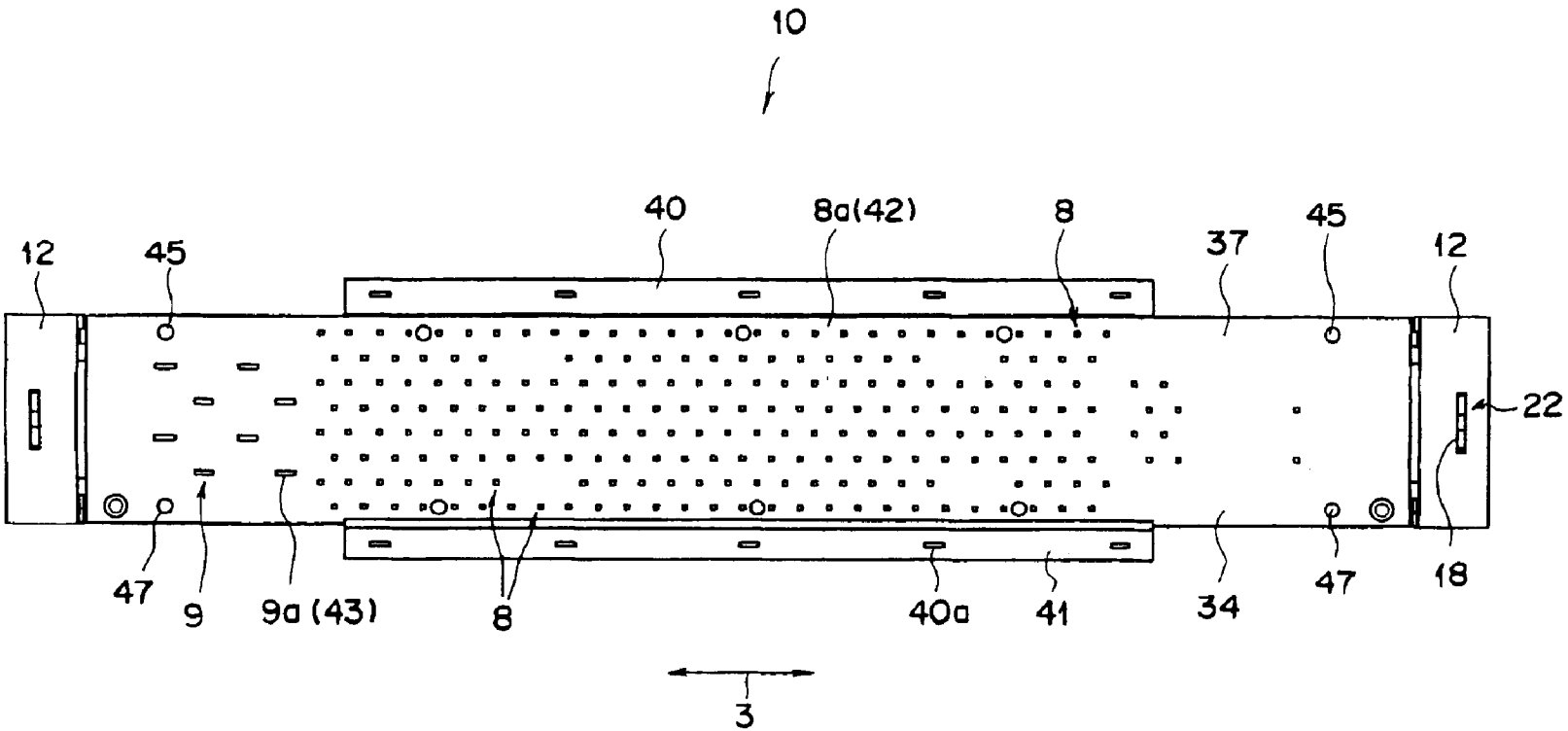
FIG. 4 is a bottom view of the plug connector of FIG. 1.
Figure 5:
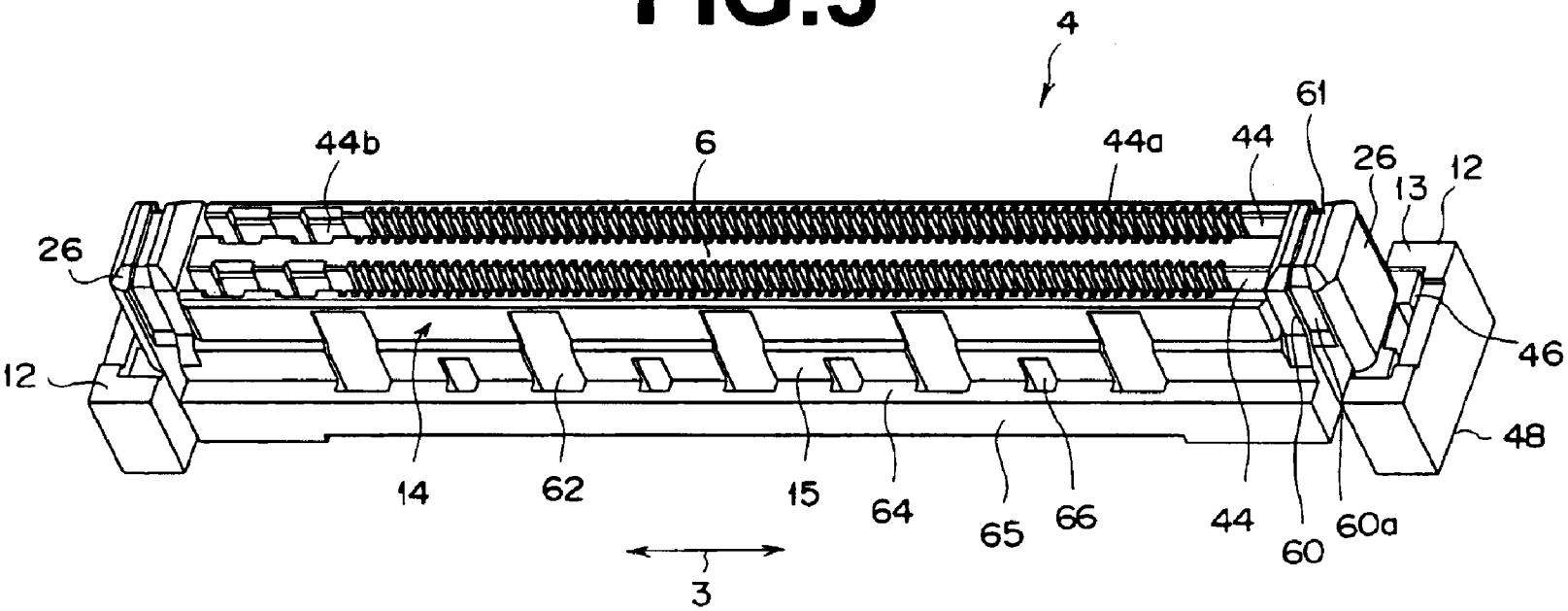
FIG. 5 is a perspective view of a housing of the plug connector.
Figure 9:
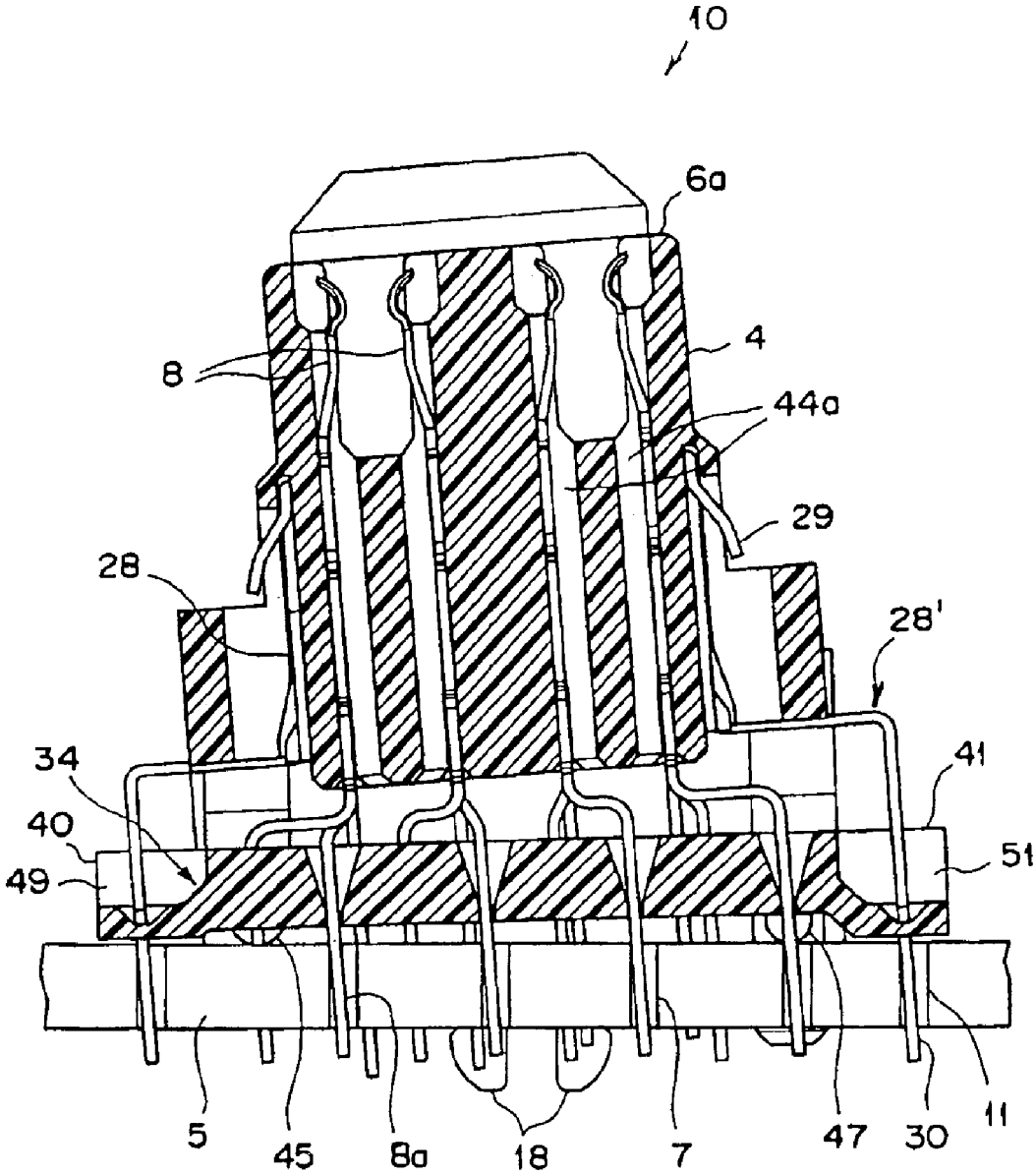
FIG. 9 is a magnified sectional view of the plug connector taken along line 9—9 of FIG. 2.

FIGS. 1–4 show a plug connector 10. The plug connector 10 has an elongated insulative housing 4. As shown in FIG. 5, the housing 4 has a parallelepiped main body 14 that extends in a longitudinal direction 3. Parallelepiped mounting portions 12 are positioned at both ends of the main body 14. As best shown in FIG. 2, upwardly facing shoulders 13 and lower and upper protrusions 38, 39, respectively, are formed on each mounting portion 12. The main body 14 and the mounting portions 12 are integrally formed from a synthetic resin. Bottom surfaces 48 of the mounting portions 12 are inclined at a predetermined angle with respect to a direction perpendicular to an engagement direction, as shown in FIG. 3. Accordingly, when the plug connector 10 is mounted on a circuit board 5, as shown in FIG. 9, the bottom surfaces 48 abut the circuit board 5 so that the plug connector 10 is mounted on the circuit board 5 in an inclined manner. A metal holding piece groove 46 is formed in each of the mounting portions 12. The metal holding piece groove 46 opens at the upwardly facing shoulder 13 and is substantially C-shaped when viewed from above.

First and second contacts 8, 9 are arranged in four rows along a longitudinal direction 3 of the housing 4 in an engagement portion 6. The first contacts 8 are narrow contacts provided for signal transfer. The second contacts 9 are wide contacts provided for power supply. The housing 4 has two engagement grooves 44 in the engagement portion 6 that extend along the longitudinal direction 3. Pluralities of contact receiving grooves 44*a*, 44*b* are formed on both sides of each of the engagement grooves 44. The contact receiving grooves 44*a* are formed to be narrow, and the contact receiving grooves 44*b* are formed to be wide. The first and second contacts 8, 9 are arranged within the contact receiving grooves 44*a*, 44*b*, respectively.

As best shown in FIG. 2, an upper front edge of the engagement portion 6 of the housing 4 has an engagement surface 6*a*. Guide posts 26 are provided at both edges of the engagement portion 6 perpendicular to the engagement direction. A groove 60*a* is formed on both side surfaces 60 and across a front surface 61 of each guide post 26 along a vertical direction thereof. The guide posts 26 cooperate with guide holes 118 formed in a receptacle connector 100, to be described later, to guide the receptacle connector 100 into engagement with the plug connector 10.

A step 65 having an upwardly facing surface 64 is formed at a lower portion of a side surface 15 of the main body 14 of the housing 4. A plurality of recesses 62, which are separated by predetermined intervals along the longitudinal direction 3, are formed on the side surface 15. Each recess 62 is formed so as to penetrate through the step 65 in a vertical direction. Engagement apertures 66, which are shorter than the recesses 62 in the vertical direction, are formed so as to penetrate the step 65 between the recesses 62.

Figures 8A, 8B, 8C, 8D:
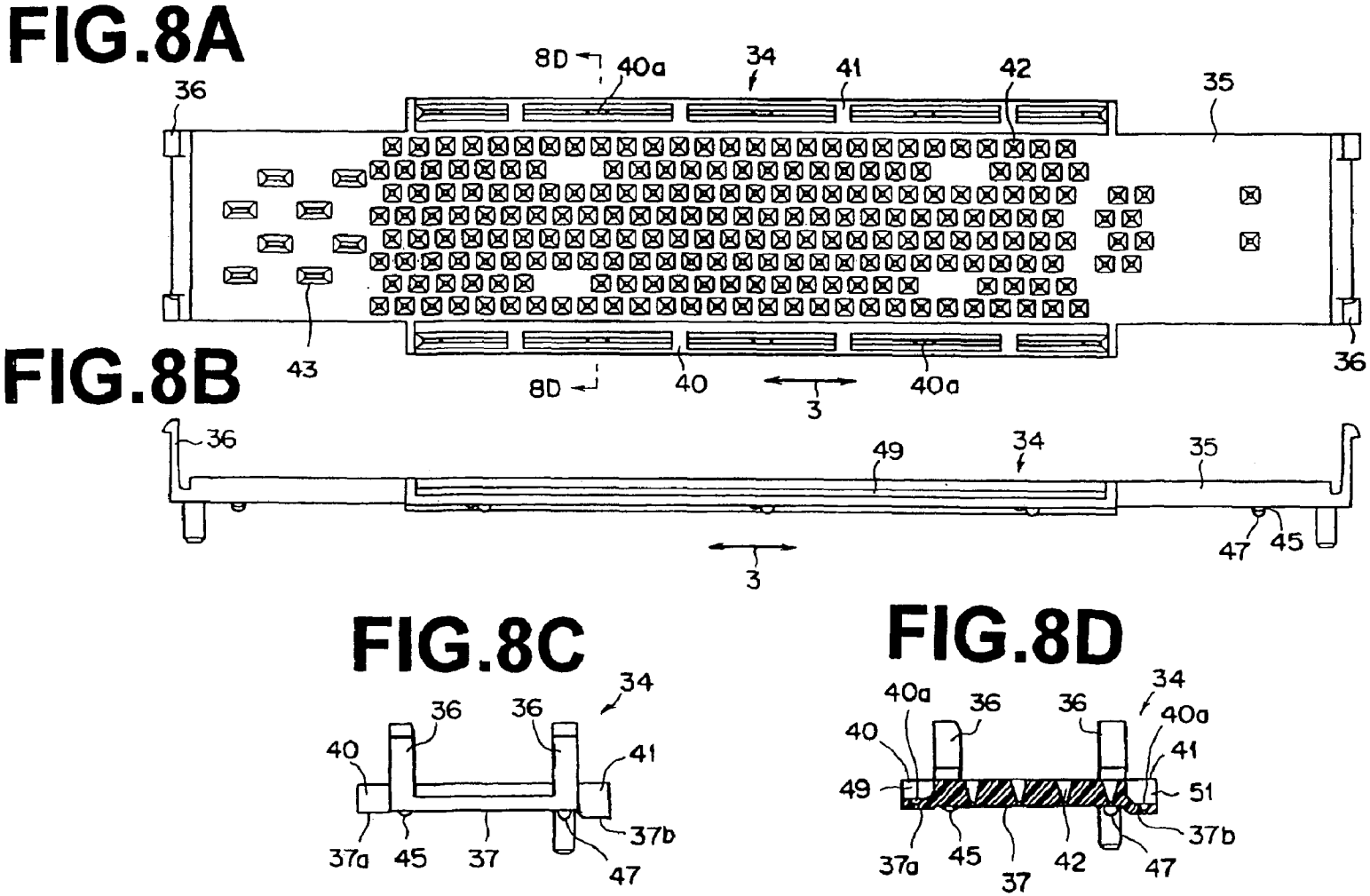
FIG. 8A is a magnified plan view of the movable contact aligning member.
FIG. 8B is a magnified front view of the movable contact aligning member.
FIG. 8C is a magnified right side view of the movable contact aligning member.
FIG. 8D is a magnified sectional view taken along line 8D—8D of FIG. 8A.

A tine plate or movable contact aligning member 34 is provided within a space 32 formed between the mounting portions 12 of the housing 4. As shown in FIG. 8, the aligning member 34 has an elongate rectangular base plate 35. Upwardly facing latch arms 36 are arranged at corners of the base plate 35 and extend toward the engagement portion 6. The latch arms 36 engage with the lower protrusion 38 of the mounting portions 12 to temporarily fix the latch arms 36 to the housing 4, as shown in FIG. 2. In this temporarily fixed state, a bottom surface 37 of the aligning member 34 is positioned slightly lower, that is, further toward the circuit board 5, than the bottom surfaces 48 of the mounting portions 12. The aligning member 34 is urged upward by the circuit board 5 to engage the upper protrusions 39 of the mounting portions 12 for permanent fixture to the housing 4 during mounting of the plug connector 10 on the circuit board 5.

Apertures 42, 43 are provided in the base plate 35 at positions corresponding to the first and second contacts 8, 9, respectively. Tines 8*a* of the first contacts 8 and tines 9*a* of the second contacts 9 are inserted through the apertures 42, 43 of the aligning member 34 and are positioned thereby. Bevels that serve as guides to facilitate insertion of the tines 8*a*, 9*a* of the first and second-contacts 8, 9 are formed in the apertures 42, 43. As best shown in FIG. 9, the tines 8*a*, 9*a* are structured so that the tines 8*a*, 9*a* positioned on a side opposite from the inclined side become progressively longer than the tines 8*a*, 9*a* positioned on the inclined side to facilitate smooth insertion of the tines 8*a*, 9*a* into through-holes of the circuit board 5.

First and second standoffs 45, 47 are formed on a bottom surface 37 of the aligning member 34 in a vicinity of the latch arms 36. The second standoff 47 protrudes from the bottom surface 37 more than the first standoff 45. The first and second standoffs 45, 47 are formed to abut the circuit board 5 when the plug connector 10 is mounted thereon. The first and second standoffs 45, 47 incline the aligning member 34 in the same direction as the housing 4. For example, when the aligning member 34 is mounted onto the housing 4 shown in FIG. 5, the first standoff 45 is positioned closer to the viewer with respect to the housing 4, and the second standoff 47 is positioned farther from the viewer.

Rectangular protrusions 40, 41 formed at a central portion of the aligning member 34 extend along the longitudinal direction 3 and in a direction coplanar with the aligning member 34. As best shown in FIG. 8, the rectangular protrusions 40, 41 have open recesses 49, 51, respectively, that open upward and outward formed therein. Mounting leg receiving apertures 40*a* are formed in the rectangular protrusions 40, 41. The mounting leg receiving apertures 40*a* correspond to mounting legs 30 of a shell 28, to be described later. Bevels that serve as guides to facilitate insertion of the mounting legs 30 are formed in the mounting leg receiving apertures 40*a*. The rectangular protrusions 40, 41 protrude from the bottom surface 37 similarly to the first and second standoffs 45, 47. The rectangular protrusion 41 on the side of the second standoff 47 protrudes more than the rectangular protrusion 40 on the side of the first standoff 45. Bottom surfaces 37*a*, 37*b* of the rectangular protrusions 40, 41 are formed so that the rectangular protrusions 40, 41 do not directly contact the circuit board 5.

As shown in FIG. 2, a metal holding piece 22, 22' (conductive member) is received in the metal holding piece groove 46 of each of the mounting portions 12. Because the metal holding piece 22 is symmetrical to the holding metal piece 22', a description will only be given for the metal holding piece 22, with the understanding that the metal holding piece 22' is of a substantially similar construction.

Figure 6C:
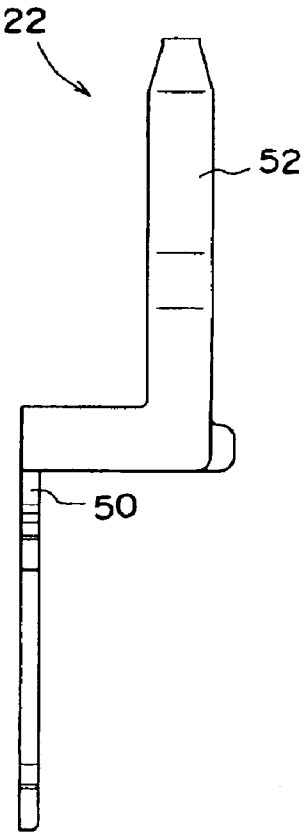
FIG. 6C is a magnified left side view of the mounting piece.
Figure 6B:
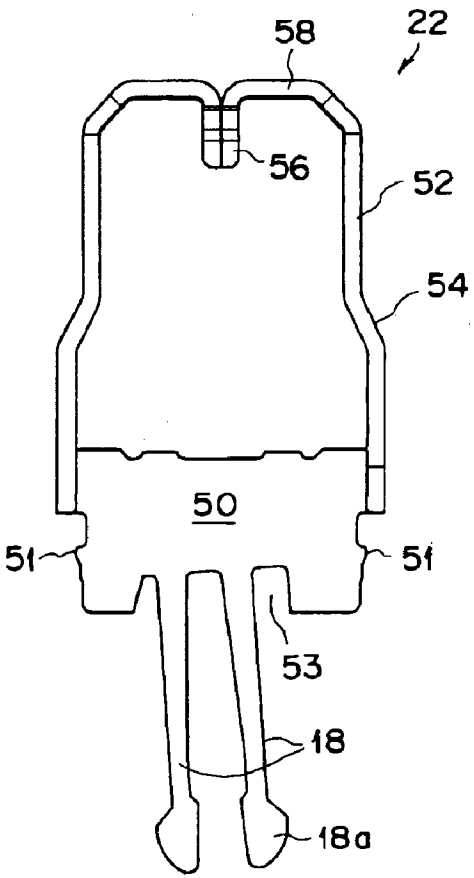
FIG. 6B is a magnified front view of the mounting piece.
Figure 6A:
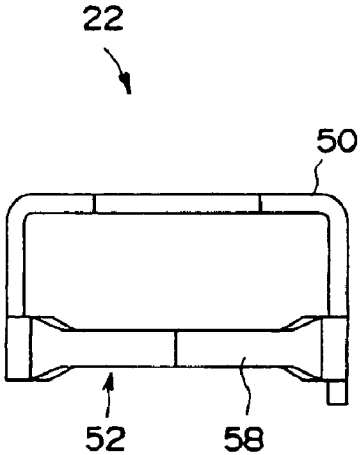
FIG. 6A is a magnified plan view of the mounting piece.

As best shown in FIG. 6, the metal holding piece 22 has a substantially rectangular base portion 50 and is formed by punching and bending a single metal plate. The base portion 50 is provided with barbs or protrusions 51 on both edges, thereof. Discharge tongue pieces 52 extend in a direction perpendicular to the base portion 50 and upward facing each other to form a step section 54. The discharge tongue pieces 52 are then bent toward each other to form a horizontal portion 58. Tips 56 thereof are then bent downward to abut each other. A cut-out 53 is formed on a lower edge of the base portion 50. Retention legs 18 (mounting legs) having outwardly extending engagement portions 18*a* formed at a tip thereof extend downward from the cut-out 53 at an angle from the base portion 50 and coplanar therewith. The engagement portions 18*a* engage with apertures (not shown) in the circuit board 5 to temporarily fix the plug connector 10 to the circuit board 5 prior to soldering. The retention legs 18 are inclined in the same direction as that of the plug connector 10 when the plug connector 10 is mounted on the circuit board 5. The degree of inclination of the retention legs 18 is smaller than that of the mounting portions 12 such that the load applied on the tines 8*a*, 9*a* of the first and second contacts 8, 9 is lessened when the plug connector 10 is mounted onto the circuit board 5, the details of which will be described later.

To attach the metal holding piece 22 to the mounting portion 12, the metal holding piece 22 is pressed into the metal holding piece receiving groove 46 from above with the retention legs 18 positioned downward. The base portion 50 and the lower portion of the tongue pieces 52 are pressed into the metal holding piece groove 46, such that the protrusions 51 frictionally engage with the inner walls of the metal holding piece groove 46 to fix the metal holding piece 22 therein. The tongue pieces 52 are seated in the groove 60*a* so that a surface of the tongue pieces 52, the side surfaces 60, and the front surface 61 of the guide post 26 become substantially coplanar. A hole (not shown) is formed in the front surface 61 of the guide post 26 for receiving the tips 56 of the tongue pieces 52. The tips 56 are forced to abut each other when received within the hole (not shown) to prevent separation from each other. As best shown in FIG. 3, the retention legs 18 protrude downward through the bottom surface 48 of the mounting portion 12 and substantially perpendicular to the inclined bottom surface 48, such that the retention legs 18 become perpendicular to the circuit board 5 when the plug connector 10 is mounted thereon. The metal holding piece 22', which is attached to the other mounting portion 12, is arranged to face the metal holding piece 22. The retention legs 18' of the metal holding piece 22' extend in a direction opposite from that of the retention legs 18 of the metal holding piece 22.

As shown in FIG. 1, shield members or shells 28, 28' are attached to the main body 14 of the housing 4. Because the shell 28 is substantially identical to the shell 28', a description will only be given for the shell 28, with the understanding that the shell 28' is of a substantially similar construction except for the elements identified herein.

Figure 7C:
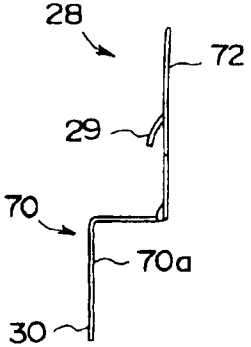
FIG. 7C is a magnified right side view of the shell.
Figure 7A:
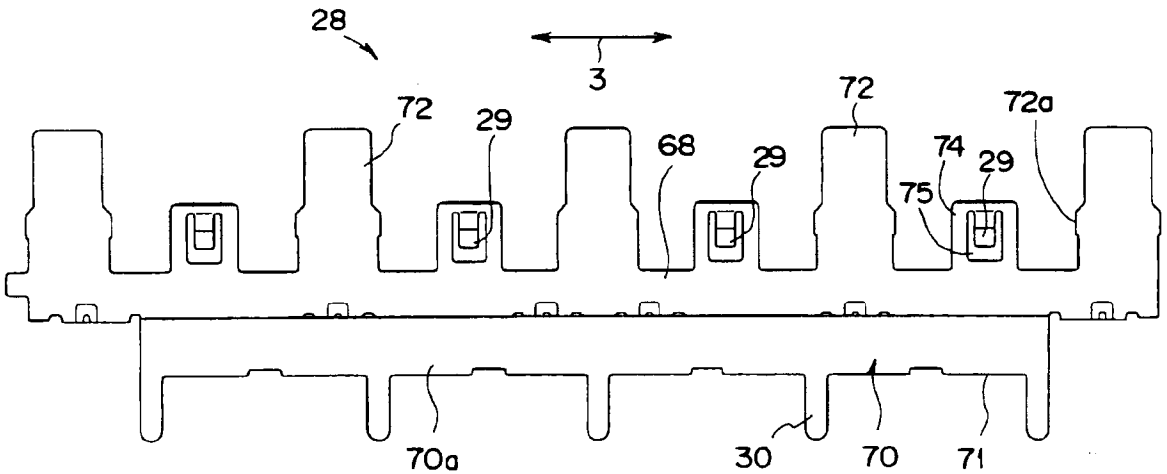
FIG. 7A is a magnified front view of the shell.
Figure 7B:
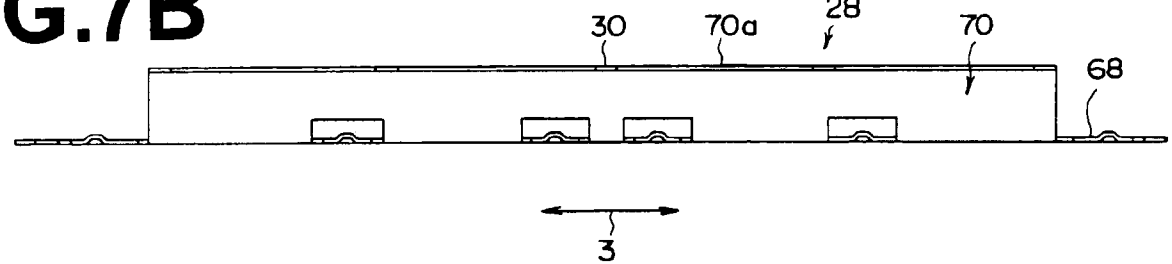
FIG. 7B is a magnified bottom view of the shell.

As shown in FIG. 7, the shell 28 is formed by punching and bending a single metal plate and has a base portion 68 that extends along the longitudinal direction 3 and an extension portion 70. The shell 28 shown in FIG. 7 represents the shell 28 that is closer to the viewer with respect to FIG. 2. The extension portion 70 is first bent from the base portion 68 perpendicular to the longitudinal direction 3 and then bent again to extend in a direction parallel to the base portion 68 and away therefrom. Mounting legs 30 are provided on a lower edge 71 of an outer portion 70*a* of the extension portion 70 and extend downward therefrom. As shown in FIG. 9, the lower edge 71 of the outer portion 70*a* of the shell 28 is made long in a vertical direction of the housing 4 without interfering with the protrusions 40, 41 of the aligning member 34 by the open recesses 49, 51 therein. The base portion 68 has upwardly facing tongue pieces 72 corresponding to the recesses-62 of the housing 4. Protruding pieces 74 are formed between the tongue pieces 72 and in the same direction therewith. Openings 75 are formed in the protruding pieces 74. Downwardly facing latch arms 29, which extend to be positioned closer to the viewer with respect to FIG. 7, are provided within the openings 75. The latch arms 29 are formed at positions corresponding to the engagement apertures 66.

The shell 28' is provided on an opposite side of the housing 4 and is formed to be inclined when the housing 4 is mounted on the circuit board 5. As shown in FIG. 3, the outer portion 70*a* of the extension portion 70 of the shell 28' is longer in the vertical direction than the shell 28. The shell is longer in the vertical direction to cover the larger space 32 formed on the opposite side due to the housing 4 being positioned farther away from the circuit board 5 due to the inclination of the housing 4. The other structural components of the shell 28' are the same as those of the shell 28.

To attach the shells 28, 28' to the housing 4, the shells 28, 28' are inserted into the housing 4 from the downward direction in FIG. 5, so that the tongue pieces 72 and the protruding pieces 74 are fitted into the recesses 62 and the engagement apertures 66, respectively. The mounting legs 30 are inserted through the mounting leg receiving apertures 40*a* and are positioned thereby. The latch arms 29 engage the upper surface 64 of the step 65 of the housing 4, and the extension portion 70 abuts the lower surface of the step 65. The shells 28, 28' are thereby prevented from being pulled out of the housing 4, while the extension portion 70 covers the space 32 of the housing 4. As a result, the extension portion 70 electromagnetically shields the tines 8*a* of the first contacts 8 that are positioned in the space 32. Sufficient shielding effects against electromagnetic interference (EMI) can be obtained by shielding just the necessary tines 8*a* from among the plurality of tines 8*a*, which are exposed in the space 32. In the alternative, all of the tines 8*a* may be shielded. It is not necessary to shield the tines 9*a* of the second contacts 9 because the second contacts 9 are provided for the power supply.

Mounting of the plug connector 10 on the circuit board 5 will now be described in greater detail with reference to FIG. 9. When the plug connector 10 is mounted on the circuit board 5, the inclined bottom surfaces 48 of the mounting portions 12 abut the circuit board 5 so that the housing 4 is arranged in an inclined state. The retention legs 18 of the metal holding piece 22 are perpendicularly inserted through apertures (not shown) in the circuit board 5 to engage therewith. Each of the first and second contacts 8, 9 are aligned by the aligning member 34 and are inserted through the through holes 7 of the circuit board 5. The mounting legs 30 of the shell 28 are inserted through shield member mounting apertures 11 of the circuit board 5 and are soldered thereto.

As shown in FIG. 9, the aligning member 34 is inclined with respect to the circuit board 5 due to the first and second standoffs 45, 47 abutting the circuit board 5. The degree of this inclination is less than that of the housing 4. The tines 8*a*, 9*a* of the first and second contacts 8, 9, which are inserted through the through holes 7, bend in the direction of the inclination of the housing 4. As a result, excessive force is applied to the tines 8*a*, 9*a*, which gives rise to problems such as cracks being generated in the solder connection portions on a rear side of the circuit board 5 and/or the housing 4 not inclining with respect to the circuit board 5 at a desired angle due to frictional resistance between the tines 8*a*, 9*a* and the aligning member 34. Problems such as these, however, are less likely to occur because the amount of stress applied on the tines 8*a*, 9*a* is reduced by the aligning member 34 not being inclined to as great a degree as the housing 4. This structure also facilities mounting of the plug connector 10 to the circuit board 5. Although it is not necessary for the first standoff 45 to be provided, the first standoff 45 ensures a more accurate setting of the degree of inclination. In a preferred embodiment, the degree of inclination of the aligning member 34 is approximately ½ that of the housing 4.

Figure 10:
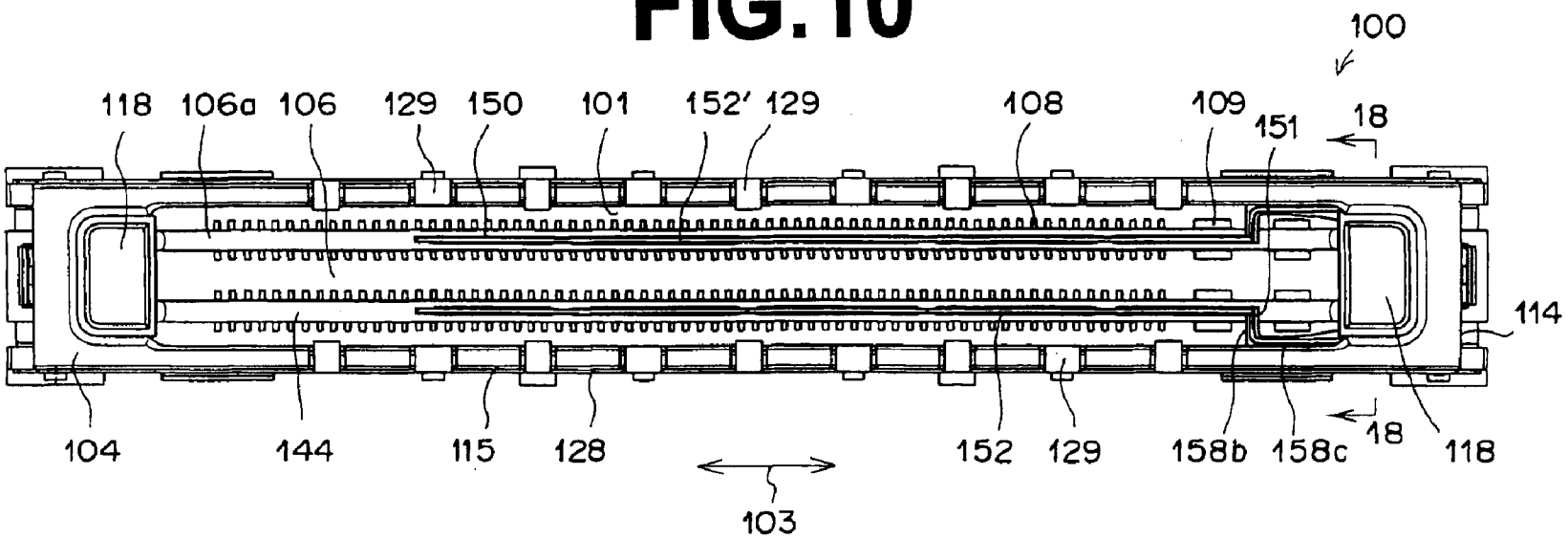
FIG. 10 is a plan view of a receptacle connector that engages with the plug connector.

The receptacle connector 100 that engages with the plug connector 10 will now be described in greater detail with reference to FIGS. 10–14. The receptacle connector 100 has an elongate parallelepiped insulative housing 104. As shown in FIG. 10, the housing 104 has an engagement portion 106 at an upper surface. An engagement recess 101 extends along a longitudinal direction 103 of the housing 104 and is formed in the engagement portion 106. Two rows of engagement ribs 144 extend in the longitudinal direction 103 and are integrally formed with the housing 104 within the engagement recess 101. The engagement ribs 144 engage with the engagement grooves 44 of the plug connector 10. An engagement surface 106*a* is formed by an upper front edge of the housing 104 at the engagement portion 106.

A plurality of first and second contacts 108, 109 are held within the housing 104. The first and second contacts 108, 109 connect with the first and second contacts 8, 9 of the plug connector 10, respectively. The first and second contacts 108, 109 are arranged in rows on both sides of each of the engagement ribs 144. The first and second contacts 108, 109 have tines 108*a*, 109*a*, respectively, for connection to a circuit board 107. The tines 108*a*, 109*a* protrude downward through the housing 104. An aligning member 116 is attached to the tines 108*a* and holds the tines 108*a* in an aligned state.

Figure 16:
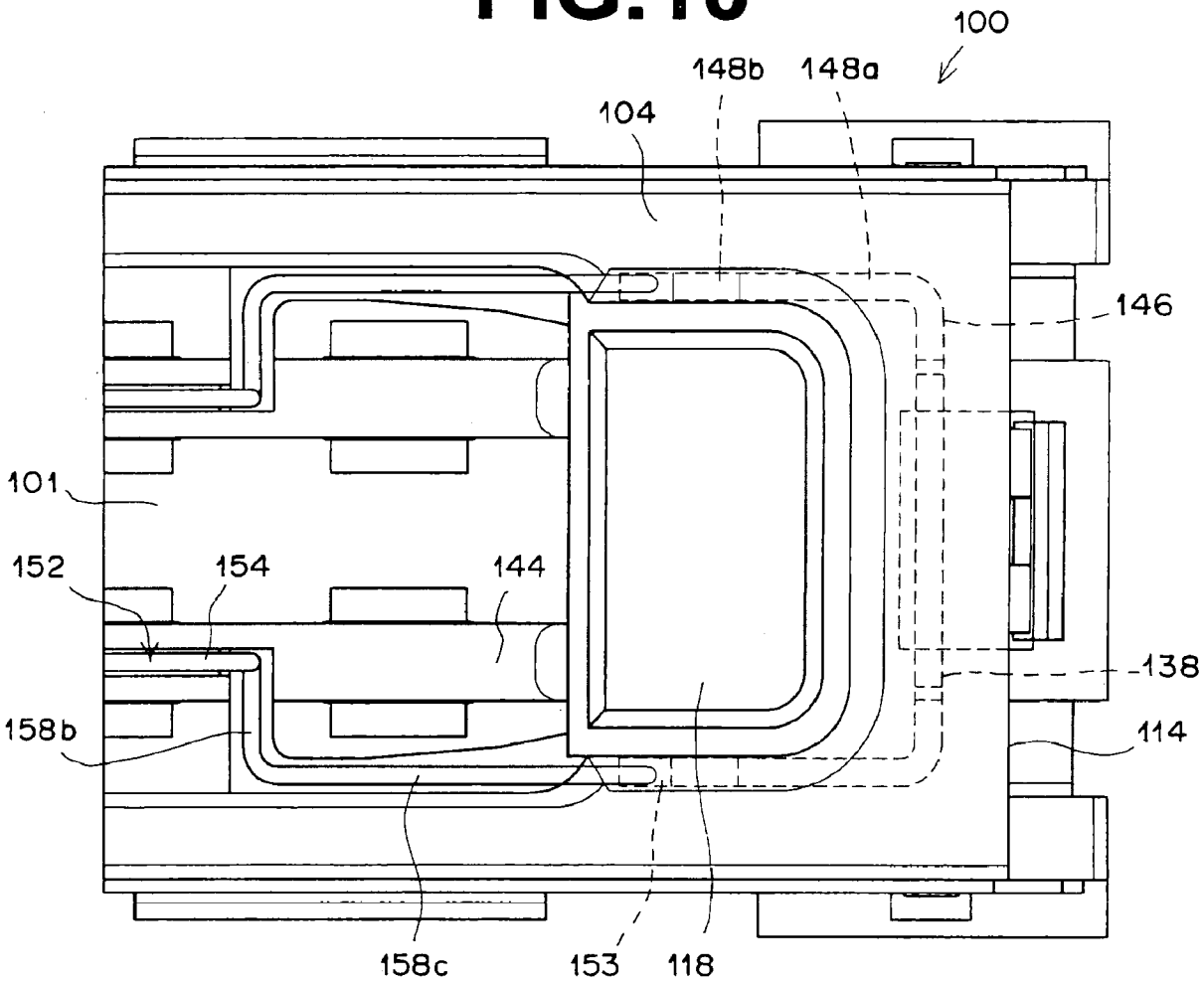
FIG. 16 is a magnified plan view of a guide hole of the receptacle connector of FIG. 10.

Guide holes 18 for receiving the guide posts 26 of the plug connector 10 are formed in the engagement portion 106 of the housing 104 near edges of the engagement portion 106 in the longitudinal direction 103. As shown in FIG. 16, a groove 138 that opens to the bottom surface of the housing 104 is formed in the housing 104 in the vicinity of the guide hole 118. Substantially rectangular protrusions 134, 136 are formed at predetermined intervals along the longitudinal direction 103 on side walls 115 of the housing 104.

Figure 11:
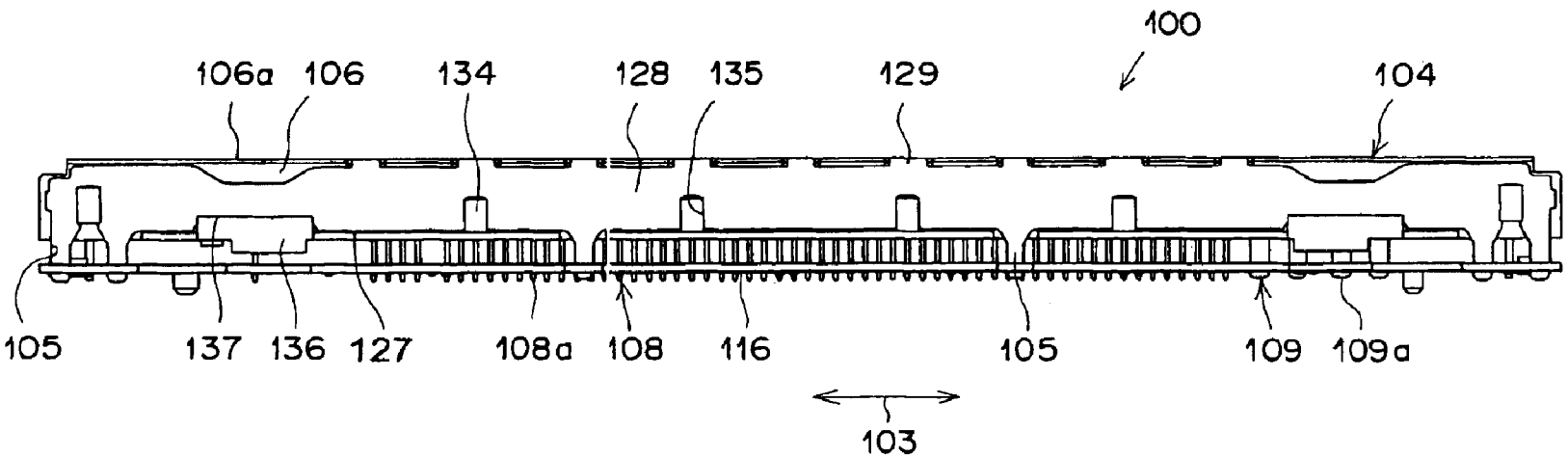
FIG. 11 is a front view of the receptacle connector of FIG. 10.
Figure 12:
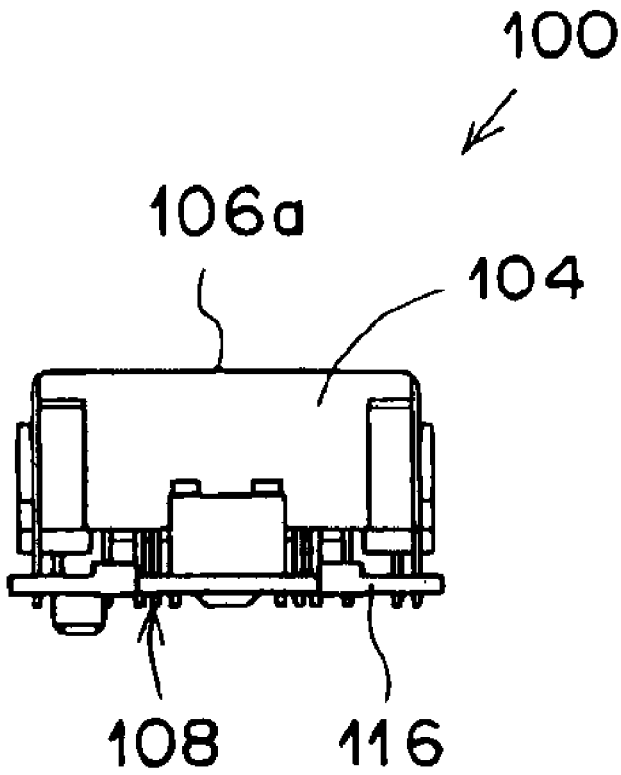
FIG. 12 is a right side view of the receptacle connector of FIG. 10.
Figure 13:
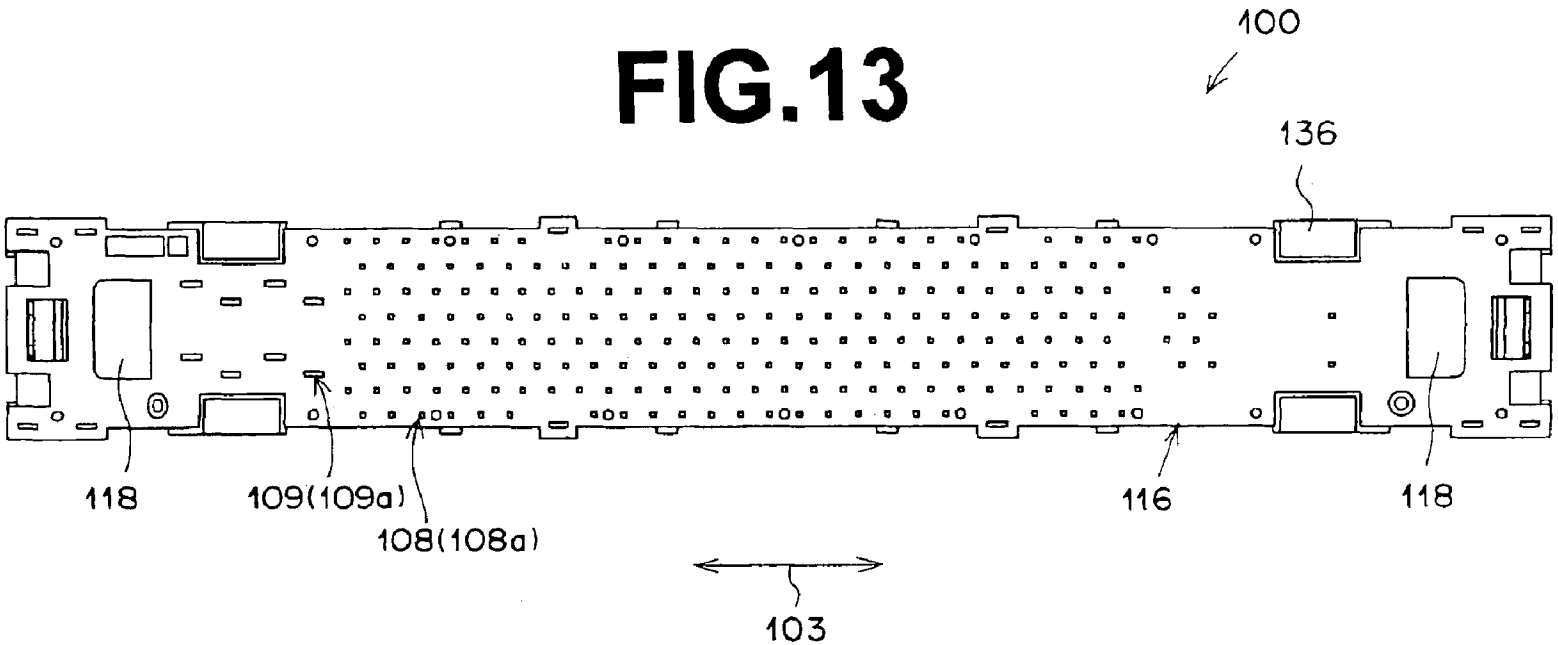
FIG. 13 is a bottom view of the receptacle connector of FIG. 10.
Figure 14:
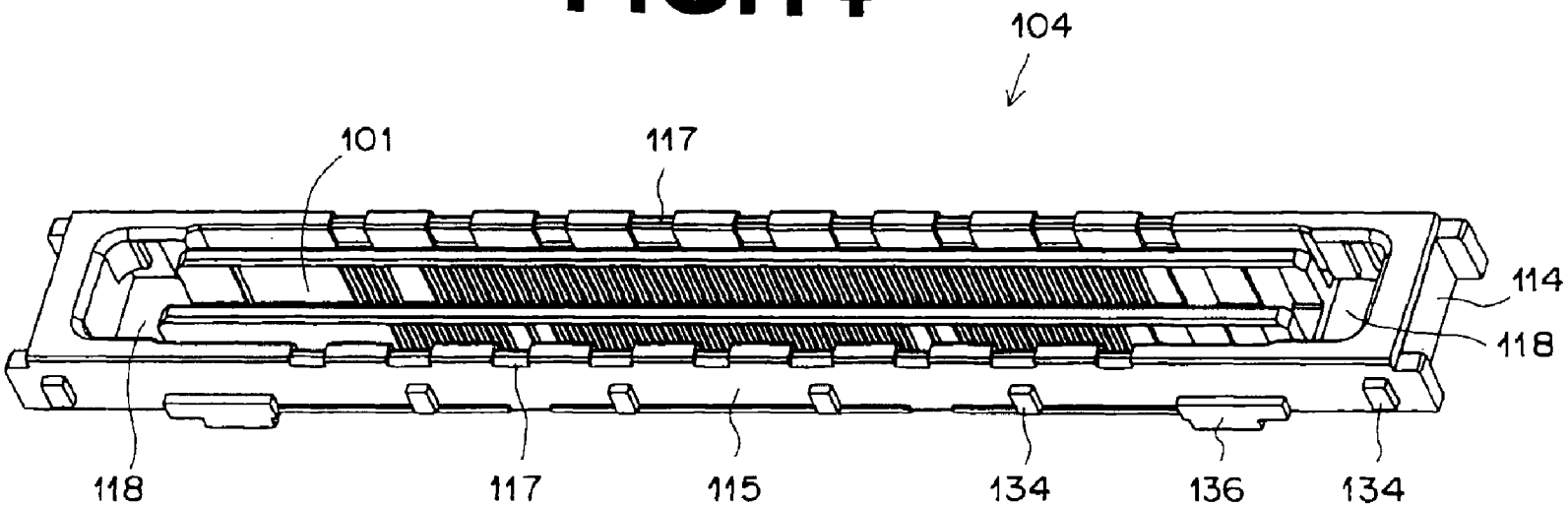
FIG. 14 is a perspective view of a housing of the receptacle connector.

A metallic shield shell 128 is structured to the cover the side walls 115 of the housing 104. As most clearly shown in FIG. 10, the shell 128 extends over the upper surface of the housing 104 and has a plurality of contact pieces 129 that extend into the engagement recess 101. The contact pieces 129 are seated within cutouts 117, shown in FIG. 14, formed in upper edges of the side walls 115 that are positioned to correspond to the contact pieces 129. As shown in FIG. 11, downwardly extending grounding legs 105 that are separated from each other are integrally formed at lower edges 127 of the shell 128. The grounding legs 105 are inserted into the circuit board 107 and are soldered thereto. Downwardly facing cut-outs 135, 137 corresponding to the rectangular protrusions 134, 136 are formed on the shell 128. The cutouts 135, 137 engage with the rectangular protrusions 134, 136 when the shell 128 is mounted on the housing 4.

Figures 15A, 15B, 15C:
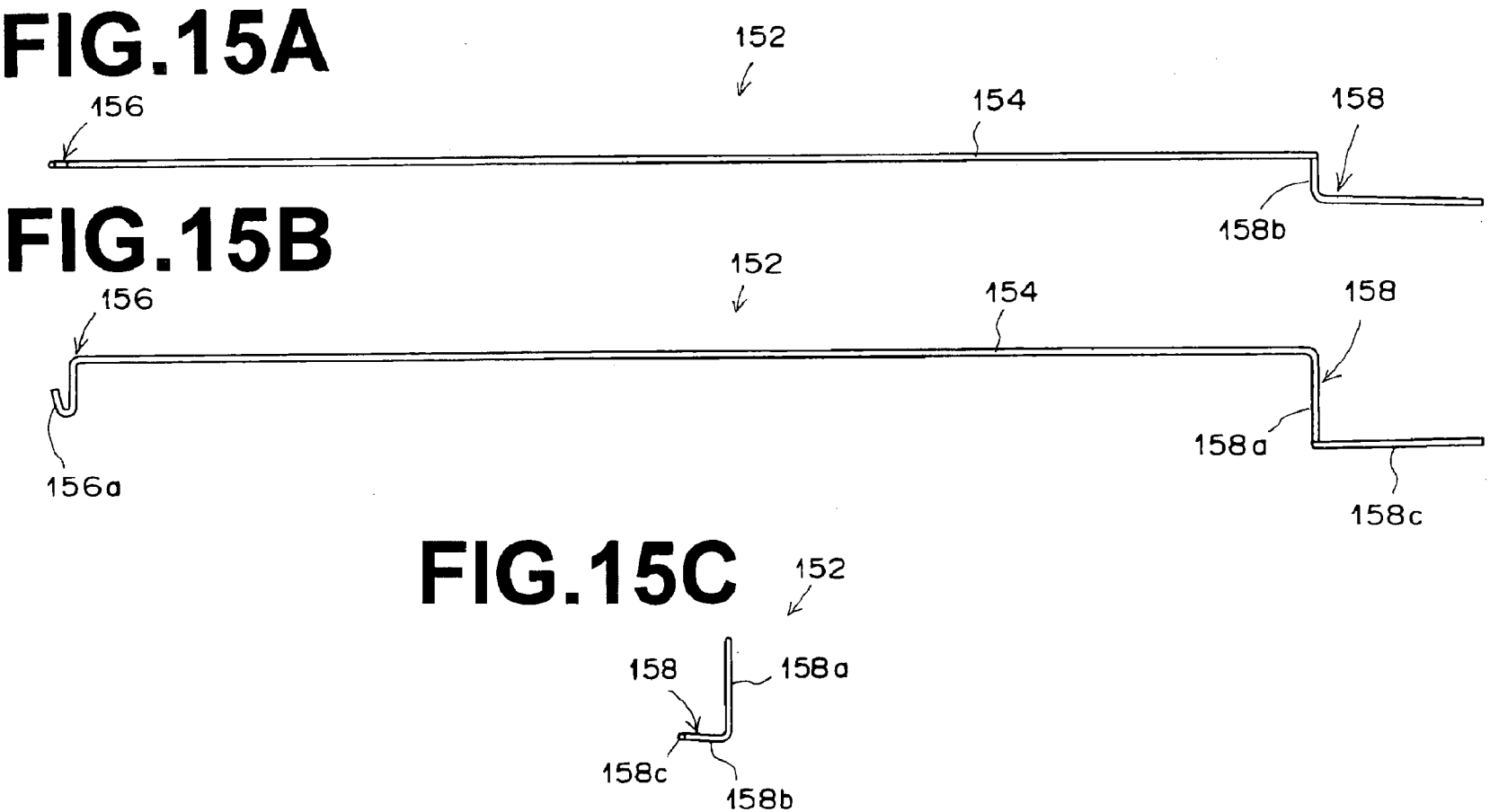
FIG. 15A is a magnified front view of the ESD wire.
FIG. 15B is a magnified front view of the ESD wire.
FIG. 15C is a magnified right side view of the ESD wire.

An electrostatic discharge function of the receptacle connector 100 will now be described in greater detail with reference to FIG. 10. Grooves 150 are formed in tips of the engagement ribs 144 in the longitudinal direction 103. Electrostatic discharge (ESD) wires 152, 152' (conductive material) are arranged within the grooves 150. As shown in FIG. 15, each ESD wire 152, 152' is formed by bending a single conductive metal wire with a linear portion 154. A hook-shaped engagement end 156 is positioned at one end of the linear portion 154. A connection portion 158 is positioned at another end of the linear portion 154. The engagement end 156 is bent at a right angle from the linear portion 154 and has a hook 156*a* at a tip thereof. The connection portion 158 at the other end comprises a downwardly extending portion 158*a* bent in the same direction as the engagement end 156. A horizontal portion 158*b* is bent at a right angle from the downwardly extending portion 158 toward the viewer with respect to FIG. 15B. A contact portion 158*c* is bent at a right angle in the same direction as the linear portion 154.

The ESD wires 152, 152' are positioned in the housing 104 by being pressed into the ribs 150 of the engagement grooves 144. Holes (not shown) are formed at the portions of the grooves 150 corresponding to the engagement ends 156. The engagement ends 156 are press-fit into the holes (not shown) and are prevented from being pulled out from the holes (not shown) by the hooks 156*a*. The connection portions 158 are positioned within the engagement recess 101 by passing through grooves 151, shown in FIG. 10, which are formed on the side surfaces of the engagement ribs 144. The contact portions 158*c* are positioned in a vicinity of one of the guide holes 118 and contact an ESD contact 146 (conductive material).

Figures 17A, 17B, 17C:
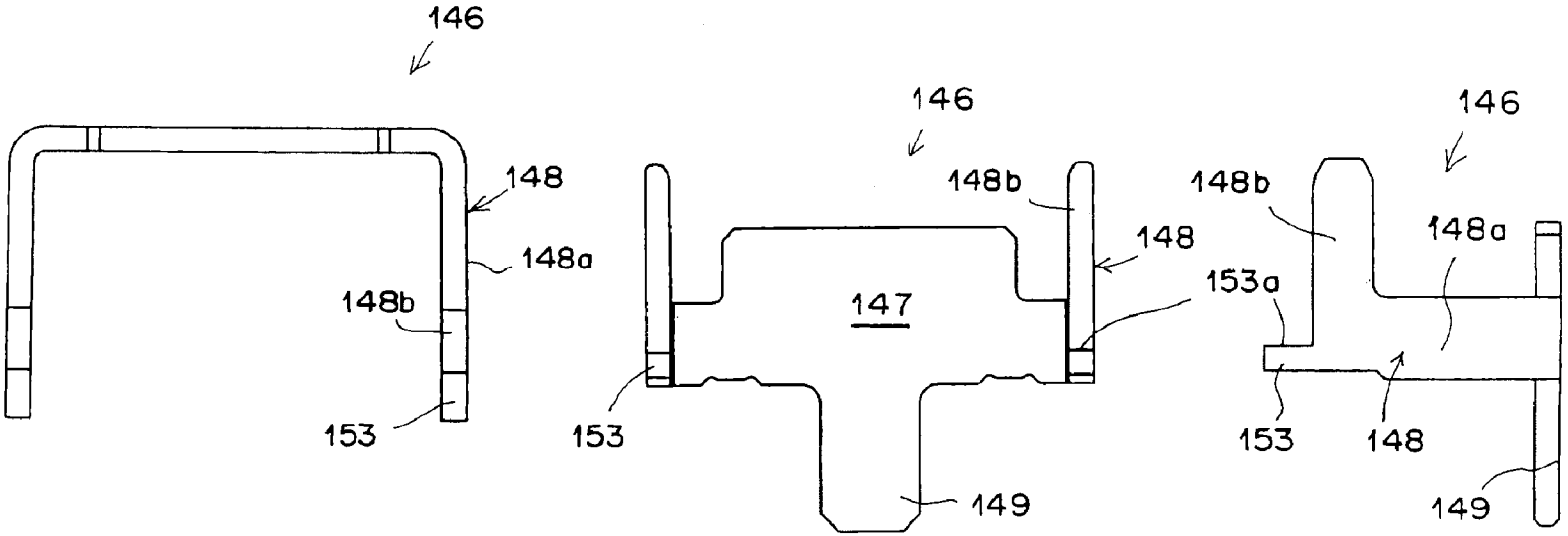
FIG. 17A is a magnified plan view of the ESD contact.
FIG. 17B is a magnified front view of the ESD contact.
FIG. 17C is a magnified side view of the ESD contact.

The contact state between the ESD contact 146 and the ESD wires 152, 152' will be described in greater detail with reference to FIGS. 16 and 17. As best shown in FIG. 17, the ESD contact 146 has a substantially rectangular base portion 147. L-shaped arms or discharge tongue pieces 148 extend perpendicularly from both lower ends of the base portion 147. The L-shaped arms 148 are constructed by horizontal arms 148*a* and vertical arms 148*b*. A downwardly extending mounting piece 149 is formed at a center of a lower edge of the base portion 147. The mounting piece 149 is inserted through an aperture of a circuit board 107 and soldered thereto. Contact pieces 153 extend in the horizontal direction and are formed coplanar with the arms 148.

Figure 18:
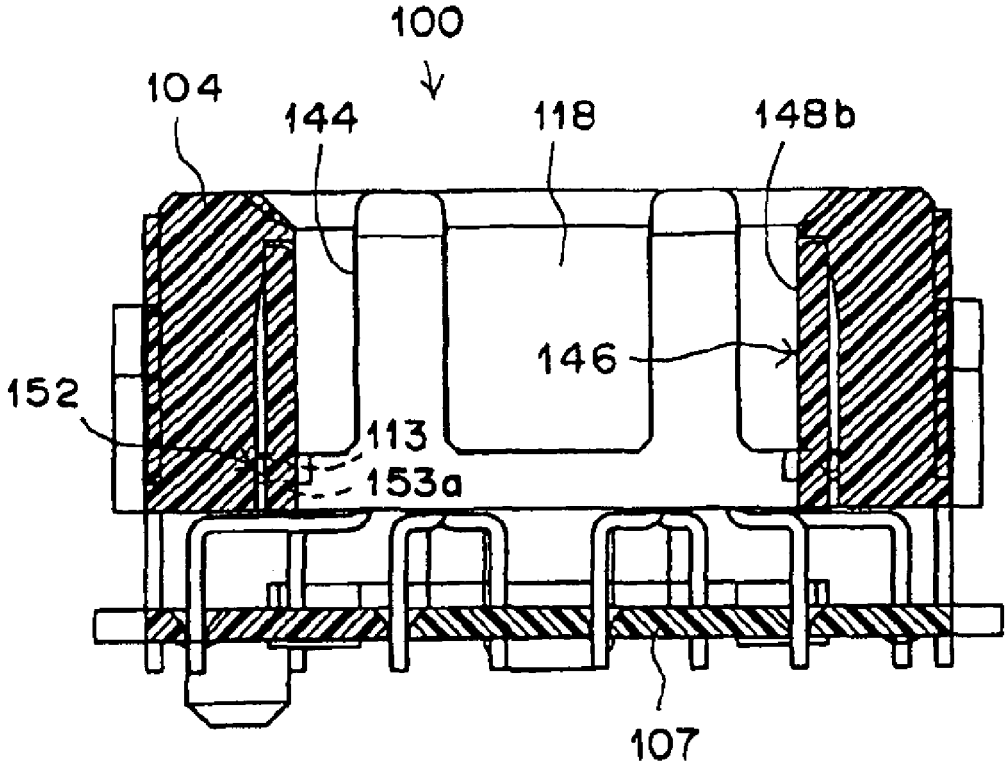
FIG. 18 is a magnified sectional view of the receptacle connector taken along line 18—18 of FIG. 10.

As shown in FIG. 18, the ESD contact 146 is positioned in the housing 104 by being press-fit into the groove 138 from the bottom surface of the housing 104 with the vertical arms 148*b* positioned upward in the vicinity of the guide hole 118. The arms 148 are positioned in the inner surfaces of the guide hold 118 such that the arms 148 are exposed within the guide hole 118. As shown in FIGS. 17 and 18, upper surfaces 153*a* of the contact pieces 153 protrude in the horizontal direction from the arms 148 and are positioned to face downwardly facing surfaces 113 of the housing 104 with a narrow space therebetween. The tips of the contact portions 158*c* of the ESD wires 152 are held between the upper surfaces 153*a* of the contact pieces 153 and the downwardly facing surfaces 113 of the housing 104 such that the tips of the contact portions 158*c* that overlap with the contact pieces 153 (indicated by the broken lines in FIG. 16) are pressed into the downwardly facing surfaces 113 of the housing 104 by the upper surfaces 153*a* of the contact pieces 153 to establish electrical connections between the ESD wires 152, 152' and the ESD contact 146. A grounding circuit is thereby formed between the plug connector 10 and the receptacle connector 100.

Figure 19C:
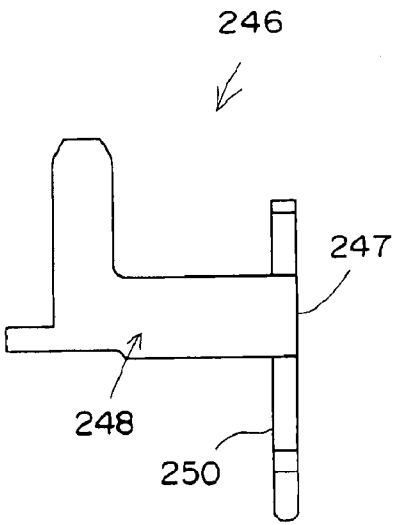
FIG. 19C is a magnified side view of the other ESD contact.
Figure 19B:
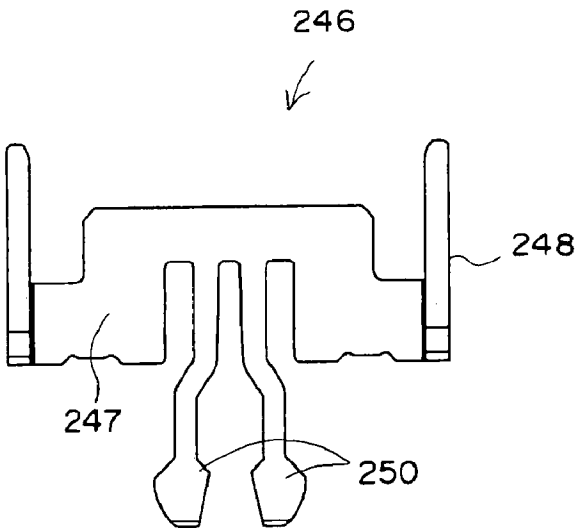
FIG. 19B is a magnified front view of the other ESD contact.
Figure 19A:
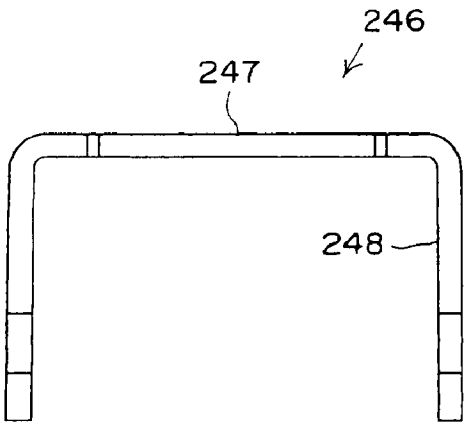
FIG. 19A is a magnified plan view of the other ESD contact.

FIG. 19 shows another embodiment of an ESD contact 246. The ESD contact 246 has a substantially rectangular base portion 247. L-shaped arms 248 extend perpendicularly from both lower ends of the base portion 247. Because the arms 248 are of substantially the same shape as the arms 148 of the ESD contact 146, a description thereof will be omitted. The ESD contact 246 differs from the ESD contact 146 in that a pair of downwardly extending elastic holding legs 250 are formed at a center of a lower edge of the base portion 247, instead of the mounting piece 149. The receptacle connector 100 may be temporarily held on the circuit board by the holding legs 250.

The electrostatic discharge function of the plug connector 10 and the receptacle connector 100 will now be described in greater detail. The function of the ESD wires 152 of the receptacle connector 100 will first be described. As shown in FIGS. 10 and 16, the first contacts 108 of the receptacle connector 100 are arranged within the engagement recess 101 so that the first contacts 108 are easily accessible from an exterior of the receptacle connector 100. The ESD wires 152 are positioned further toward the exterior than the first and second contacts 108, 109 so that the ESD wires 152 protect the first and second contacts 108, 109 from static electricity. Accordingly, if a hand, finger, or an external object which is charged with static electricity approaches the engagement portion 108, the static electricity is discharged between the hand, finger, or external object and the ESD wires 152 such that it does not affect the paths of the first and second contacts 108, 109. The static electricity that flows through the ESD wires 152 flows to a grounding circuit of the circuit board via the ESD contact 146.

In a case that either or both of the plug connector 10 and the receptacle connector 100 are charged with static electricity when the plug connector 10 and the receptacle connector 100 are engaged, discharge occurs as the receptacle connector 100 and the plug connector 10 approach each other. The metal holding piece 22 of the plug connector 10 and the ESD contact 146 of the receptacle connector 100 prevent negative influences exerted by the discharge between the plug connector 10 and the receptacle connector 100. The horizontal portion 58 of the metal holding piece 22 is used for discharge and is positioned at the tip of the guide post 26 such that the horizontal portion 58 is positioned at the most distal end of the plug connector 10 in the engagement direction. The ESD contact 146 is positioned within the guide hole 118 that the guide post 26 is inserted into. Discharge occurs between the horizontal portion 58 and the ESD contact 146 before it occurs between the first contacts 8, 108 or the second contacts 9, 109, during engagement of the plug connector 10 and the receptacle connector 100. That is, discharge occurs between the horizontal portion 58 of the metal holding piece 22 and the vertical arms 148*b* of the ESD contact 146, corresponding to the degree of charge.

The horizontal portion 58 of the metal holding piece 22 and the vertical arms 148 are pressed surfaces and have a planar spread, thus a large discharge surface that covers a wide region can be achieved. In addition, discharge is easily accomplished even if the plug connector 10 and the receptacle connector 100 are positionally mis-aligned with respect to one another, because the distances between the first contacts 8, 108 and the second contacts 9, 109 are set to be greater than the distance between the horizontal portion 58 and the tips of the vertical arms 148*b*. The ESD contact 146 and the metal holding piece 22 are both connected to grounding circuits of the respective circuit boards so that no influence is exerted on the electrical path.

The shells 28, 28', 128 form a grounding circuit by the tongue pieces 72 of the plug connector 10 and the contact pieces 129 of the receptacle connector 100 contacting each other when the plug connector 10 and the receptacle connector 100 engage each other. This grounding circuit is separate from the aforementioned grounding circuit for electrostatic discharge. This construction prevents negative influence from being exerted to the grounding circuit formed by the shells 28, 28', 128 by a high voltage current that flows through the electrostatic discharge grounding circuit.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector, comprising:

an insulative housing having a mounting surface that is inclined at a predetermined angle with respect to a plane perpendicular to an engagement direction with another connector;

a plurality of contacts arranged in the insulative housing, each of the contacts having a tine that extends parallel to the engagement direction for insertion into through-holes of a circuit board; and an aligning member attached to the insulative housing, the aligning member having a plurality of apertures for receiving and aligning the tines and standoffs that reduce bending stress applied to the tines, the standoffs abut the circuit board, so that the aligning member inclines at an angle less than the predetermined angle when the insulative housing is mounted on the circuit board.

2. The electrical connector of claim 1, wherein the standoffs incline the aligning member in the same direction as the insulative housing.

3. The electrical connector of claim 1, wherein the tines on a side opposite an inclined side of the insulative housing become progressively longer than the tines on the inclined side.

4. The electrical connector of claim 1, wherein the apertures are beveled to facilitate insertion of the tines.

5. The electrical connector of claim 1, wherein the standoffs are provided on a bottom surface of the aligning member along a longitudinal direction thereof on both an inclined side and a side opposite from the inclined side.

6. The electrical connector of claim 5, wherein the standoffs on the inclined side protrude less than the standoffs on the side opposite from the inclined side to incline the aligning member.

7. An electrical connector, comprising:

an insulative housing having a mounting surface that is inclined at a predetermined angle with respect to a plane perpendicular to an engagement direction with another connector;

a plurality of contacts arranged in the insulative housing, each of the contacts having a tine that extends parallel to the engagement direction for insertion into through-holes of a circuit board; and an aligning member with a base plate having a plurality of apertures for receiving and aligning the tines, the base plate having standoffs that protrude from the base plate to abut the circuit board such that bending stress applied to the tines by the inclined mounting surface is reduced, the standoffs incline the aligning member in the same direction as the mounting surface.

8. The electrical connector of claim 7, wherein the standoffs are arranged so that the aligning member inclines at a smaller angle than the mounting surface.

9. The electrical connector of claim 7, wherein the apertures are beveled to facilitate insertion of the tines.

10. The electrical connector of claim 7, wherein the standoffs are provided on a bottom surface of the base plate along a longitudinal direction thereof.

11. The electrical connector of claim 10, wherein the standoffs on one side of the bottom surface of the base plate protrude a smaller distance from the bottom surface than the standoffs on the other side of the base plate.

12. An aligning member for an inclined electrical connector, comprising:

a base plate having a plurality of apertures for receiving and aligning tines of contacts that extend from a housing of the inclined electrical connector, the base plate having standoffs that protrude from the base plate to abut a circuit board such that bending stress applied to the tines by the inclined electrical connector is reduced, and the standoffs incline the aligning member in the same direction as the housing.

13. The aligning member of claim 12, wherein the standoffs are arranged so that the aligning member inclines at a smaller angle than the housing.

14. The aligning member of claim 12, wherein the apertures are beveled to facilitate insertion of the tines.

15. The aligning member of claim 12, wherein the standoffs are provided on a bottom surface of the base plate along a longitudinal direction thereof.

16. The aligning member of claim 15, wherein the standoffs on one side of the bottom surface of the base plate protrude a smaller distance from the bottom surface than the standoffs on the other side of the base plate.

17. The aligning member of claim 12, wherein the aligning member is moveable with respect to the housing.

* * * * *